US005482241A

United States Patent [19]

Oglesby

[11] Patent Number: 5,482,241

[45] Date of Patent: Jan. 9, 1996

[54] ARCHERY BOW SUPPORT

[76] Inventor: Harvey D. Oglesby, 600 Hopewell Ridge Rd., Anderson, S.C. 29621

[21] Appl. No.: 373,064

[22] Filed: Jan. 17, 1995

[51] Int. Cl.[6] ..... A47F 5/00

[52] U.S. Cl. ..... 248/309.1; 124/23.1; 211/13; 211/60.1; 248/217.4

[58] Field of Search ..... 248/309.1, 217.4; 211/13, 60.1; 124/23.1, 86

[56] References Cited

U.S. PATENT DOCUMENTS

| | | | |
|---|---|---|---|
| 162,171 | 4/1875 | Hudson . | |
| 3,689,016 | 9/1972 | Hammon | 248/309.1 |
| 3,727,868 | 4/1973 | Buchanan | 248/309.1 X |
| 4,474,296 | 10/1984 | Hartman | 211/13 |
| 4,722,501 | 2/1988 | Ruhl | 248/218.4 |
| 4,846,140 | 7/1989 | Dimartino | 124/86 X |
| 5,039,052 | 8/1991 | Carafice | 248/309.1 |
| 5,048,504 | 9/1991 | Ballard | 124/86 |
| 5,183,231 | 2/1993 | Pellerin | 211/13 X |
| 5,370,240 | 12/1994 | Hand | 211/60.1 X |
| 5,377,657 | 1/1995 | Foster | 124/23.1 X |

OTHER PUBLICATIONS

Archery 1994, Item C—Tree Lag Bow Holder, p. 69.

*Primary Examiner*—J. Franklin Foss
*Attorney, Agent, or Firm*—Gerald R. Boss; Cort Flint

[57] ABSTRACT

The present invention provides an archery bow support for supporting an archery bow in an upright position when attached to an upstanding support. The archery bow support includes a bow holder which defines a bow receptacle and a bow passage leading into the bow receptacle for retaining the bow in an upright position. The bow receptacle is larger than the depth of the bow's hand grip for retaining the bow within the bow holder. The bow holder passage is smaller than the depth of the hand grip while being larger than the width of the hand grip. A mount brace mounts the bow support to an associated structure.

8 Claims, 2 Drawing Sheets

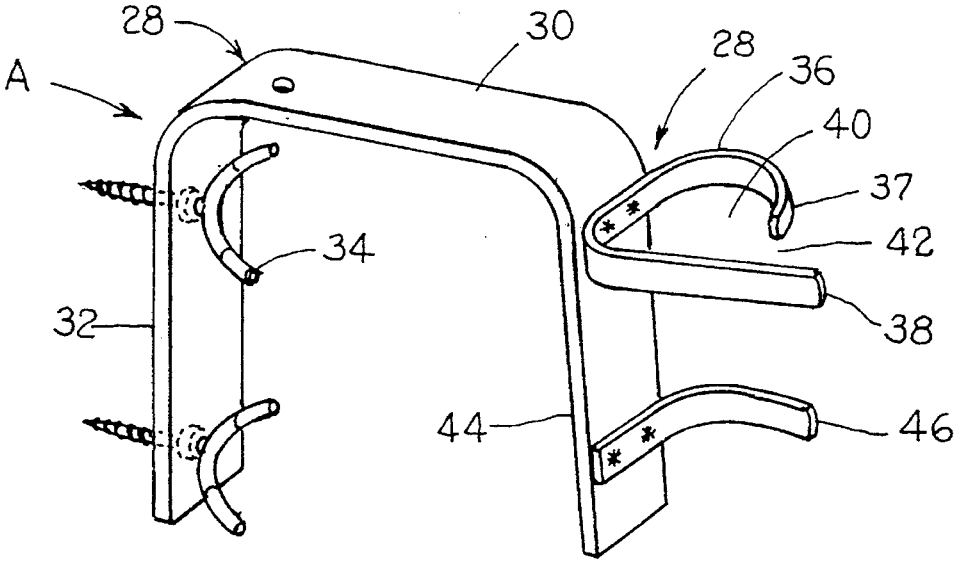
Fig. 2.
Fig. 3.
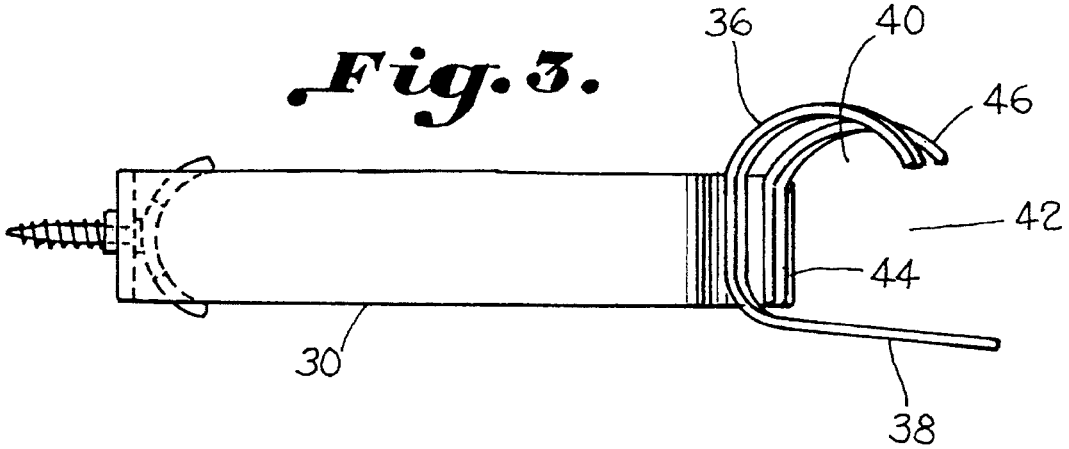
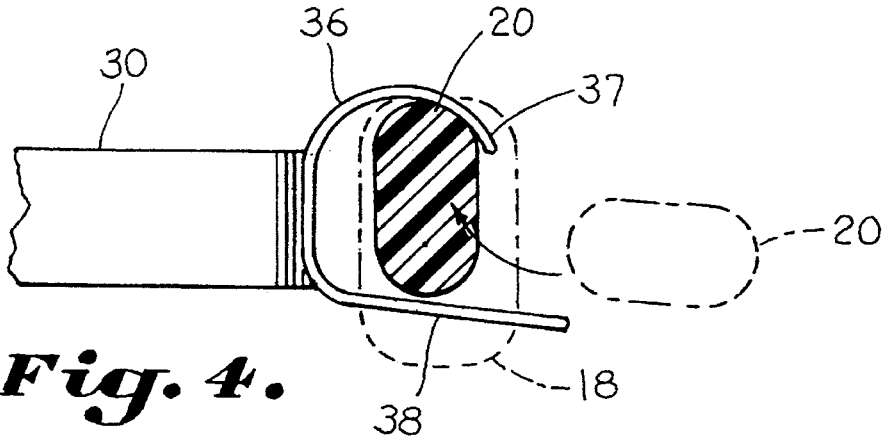
Fig. 4.

ARCHERY BOW SUPPORT

BACKGROUND OF THE INVENTION

This invention relates generally to a device for supporting a bow and more particularly to a bow support for supporting a hunter's bow in a vertical and easily accessibly position near the hunter so that the hunter may quickly access the bow.

While hunting, a bow hunter generally awaits game in a secretive camouflaged manner or on a hunting stand. Accordingly, the bow hunter generally will rest the bow on the ground or in some other fashion instead of holding the bow during the waiting period.

Additionally, the hunter may require to have his hands free in order to simulate natural sounds to attract the game. Various bow hangers have been developed. U.S. Pat. No. 4,722,501 discloses a bow hanger having a steel rod bent at a substantially right angle at the rear end to fit into and be retained by a clevis while also having the forward end of the rod being upwardly angulated so that the bow may be hung on the rod. Such a device, places the bow in an unstable and precarious situation, especially when used with a tree stand. The bow is subject to swaying and may accidentally be dislodged from the rod requiring the hunter to descend the tree to retrieve the bow.

Other devices for securing the bow against a tree include affixing a prong having two fingers generally the length of the depth of the archery bow directly to a tree placing the bow directly against the tree. Such an arrangement does not provide easy access to the bow when the urgent need to access arises by the sudden appearance of game.

Accordingly, it is an object of the present invention to provide an archery bow support for supporting an archery bow in an upright and ready position.

Furthermore, it is another object of the present invention to provide an archery bow support which interlocks the archery bow in a easily accessible upright position.

Also, it is an object of the present invention to provide an archery bow support which permits the bow to be quickly and easily removed for use.

It is also an object of the present invention to provide a bow support that can be readily installed on or removed from a tree or other upstanding support.

SUMMARY OF THE INVENTION

The above objectives are accomplished according to the present invention by providing an archery bow support for supporting an archery bow in an upright position when attached to an upstanding structure. The archery bow support includes a bow holder which defines a bow receptacle and a bow passage leading into the bow receptacle for retaining the bow in an upright position. The bow receptacle is larger than the depth of the bow's hand grip for retaining the bow within the bow holder. The bow holder passage is smaller than the depth of the hand grip while being larger than the width of the hand grip. Accordingly, the bow is rotated to a side facing position for being received thru the bow passage and thereafter roatated to a forward facing position for retention within the bow receptacle. A mount mounts the bow support to an associated structure.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is a perspective view of an archery bow holder according to the invention;

FIG. 3 is a top view of an archery bow holder according to the invention;

FIG. 4 is a perspective view taken along line 4—4 of FIG. 1 of an archery bow being placed in a side facing position to be received by an archery bow holder and rotated to a forward facing to be interlocked within an archery bow holder according to the invention.

DESCRIPTION OF A PREFERRED EMBODIMENT

Figure 1:
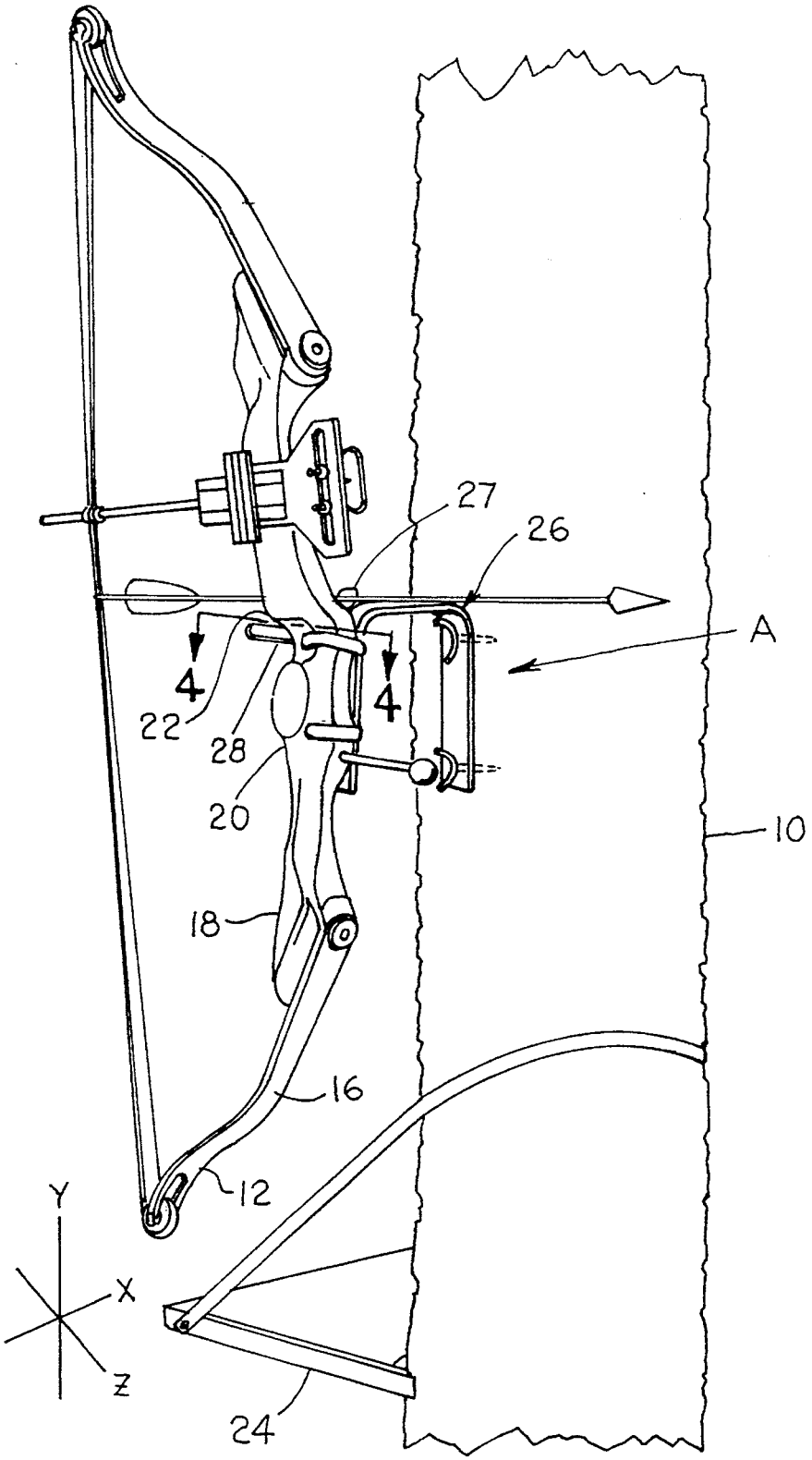
FIG. 1 is a perspective view of an archery bow holder attached to an upstanding support according to the invention.

Referring now in more detail to the drawings, the invention will now be described in more detail. FIG. 1 illustrates archery bow support A attached to tree 10. Archery bow 12 is interlocked within archery bow support A and secured in an upright position. Archery bow 12 is illustrated as a standard compound bow having limbs 16 and riser 18. Riser 18 includes hand grip 20 having a lip 22. Riser 18 has a predetermined length, width and depth. For purposes of explaining the invention and for points of reference, the riser's length is defined along the Y axis, the width along the X axis and the depth along the Z axis as illustrated in FIG. 1.

As shown in FIG. 1, archery bow support A is intended for use in conjunction with an upstanding structure such as tree 10. Normally, bow hunters use tree stand 24 attached to tree 10 above the ground. Since the tree stand is high in the air, it is important that archery bow 12 be firmly maintained in an upright position so that it will not be accidently dislodged and plummet to the ground. By having the bow in an upright position, the hunter can quickly access the bow to release an arrow.

As shown in FIGS. 1, 2, and 3, archery bow support A includes mount 26 and bow holder 28. Mount 26 attaches bow holder 28 to tree 10. Mount 26 includes an extension arm 30 for extending bow holder 28 away from tree 10. The archer may utilize bow 12 which has a sight or arrow holder 27 extending laterally away from the bow. Consequently, it is necessary to position the archery bow away from the upstanding support to provide lateral clearance for these bow accessories.

In the preferred embodiment, mount 26 includes mounting leg 32 which depends generally vertically from extension arm 20 enabling mount 26 to abut tree 10. The bow's weight is initially supported by bow holder 28 and transferred along extension arm 30 to mounting leg 32 causing mounting leg 32 to abut tree 10. Consequently, tree 10 resists the downward weight of archery bow 12 maintaining bow 12 in an upright position. Mounting leg 32 includes apertures for receiving fasteners 34. Fasteners 34 may be screws which fasten mount 26 to tree 12.

As shown in FIGS. 1, 2 and 3, bow holder 28 is carried by extension arm 30 away from tree 12. Bow holder 28 includes first hook element 36. First hook element 36 terminates in distal arcuate finger 37. First hook element 36 has an interior diameter from the proximate end attached with extension arm 30 to distal finger 37 greater than the width of archery bow 12. Bow holder 28 also includes horizontal member 38 which is spaced from first hook element 36. Both first hook element 36 and horizontal member 38 extend horizontally outward from extension arm 30. First hook element 36 in combination with horizontal member 38 define receptacle 40 which is a vertical passageway for receiving archery bow 12 in an upright position. Receptacle 40 is larger than the width and depth of hand grip 20 for receiving hand grip 20.

Horizontal member 38 extends at least parallel to distal arcuate finger 37 of first hook element 36. Horizontal member 38 is spaced away from distal arcuate finger 37 to define bow holder opening 42. As shown in FIG. 4, the spacing between distal arcuate finger 37 and horizontal member 38 is less than the depth of hand grip 20 but greater than the width of hand grip 20. In this manner, archery bow 12 can only be received within receptacle 40 by passing through bow holder opening 42 in a side facing position.

As shown in FIG. 4, archery bow 12 is rotated into a side facing position enabling the width of archery bow 12 to be received by bow holder opening 42. In the side facing position, archery bow 12 is passed through bow holder opening 42 and received by receptacle 40. Once archery bow 12 is received within receptacle 40, archery bow 12 is rotated 90 degrees into a forward facing position. Lip 22 of hand grip 20 rests on top of bow holder 28 for maintaining bow 12 within bow holder 28. In the forward facing position, distal arcuate finger 37 curves around the side of archery bow 12 maintaining archery bow 12 within receptacle 12 locking archery bow 12 in the forward facing position. Archery bow 12 is maintained in receptacle 40 by arcuate finger 37 and may only be released by rotating archery bow to the side facing position.

As shown in FIGS. 1, 2 and 3, vertical bow support leg 44 depends downward from extension arm 30. Archery bow 12 may rest against vertical bow support leg 44 when in the forward facing position further stabilizing archery bow 12 and maintaining it in an upright condition. Also, second hook element 46 may be positioned beneath bow holder 28 on vertical bow support leg 44. Second hook element 46 generally parallels first hook element 36 and wraps around the front of riser 18 at a second location near the hand grip. Second hook element 46 provides a second point of contact against the front portion of the riser in conjunction with first hook element 36, preventing archery bow 12 from swaying within bow holder 28 while in an upright position.

Thus it can be seen that an advantageous construction can be had for an archery bow holder according to the present invention where the bow may readily be secured and maintained in an upright position while being easily removed for hunting. When utilized, the archery bow is interlocked by the bow holder to prevent swaying and accidental dislodging. The bow holder is easily used by positioning the bow in a first position for receipt by the bow holder and rotated into a second position for interlocking with the bow. The bow is easily removed from the bow holder by rotating the bow back into the first position allowing for easy exit from the bow holder.

While a preferred embodiment of the invention has been described using specific terms, such description is for illustrative purposes only, and it is to be understood that changes and variations may be made without departing from the spirit or scope of the following claims.

What is claimed is:

1. An archery bow support for supporting an archery bow in an upright position, said archery bow support for use in association with an upstanding structure such as a tree, said archery bow having a hand grip of a given width as measured along the front of said grip and a given depth as measured along the side of said grip and said bow having a lip above said hand grip and extending beyond the hand grip towards the bow string of said bow, said archery bow support comprising:

a mount for mounting said bow support to an associated structure;

a bow holder carried by said mount for retaining said bow in an upright position;

said bow holder including a horizontally disposed first hook element terminating in a horizontally disposed distal finger;

a horizontal member carried by said bow holder spaced opposite said first hook element and said distal finger;

said first hook element and said horizontal member defining a bow receptacle for receiving said archery bow in a vertical position;

said horizontal member and said distal finger defining a bow passage leading into said bow receptacle;

said bow holder passage being smaller than the depth of said hand grip, and said bow passage being larger than the width of said hand grip, so that said bow may be rotated to a side facing position for being received thru said bow passage and thereafter roatated to a forward facing position for retention within said bow receptacle;

whereby said bow holder supports said archery bow in an upright position for easy accessibility.

2. The archery bow support of claim 1 including an extension arm carried by said mount extending generally horizontally away from said associated structure when said mount is attached to said associated structure.

3. The archery bow support of claim 2 including a vertical bow support leg depending from said extension arm beneath said bow holder for supporting said bow in a generally vertical position.

4. The archery bow support of claim 3 including a second hook element carried by said vertical bow support leg, said second hook element disposed below said first hook element, said second hook element providing said bow holder with two points of contact with said archery bow restricting the movement of said archery bow.

5. An archery bow support for supporting an archery bow in an upright position, said archery bow support for use in association with an upstanding structure such as a tree, said archery bow having a hand grip of a given width as measured along the front of said grip and a given depth as measured along the side of said grip and said bow having a lip above said hand grip and extending beyond the hand grip towards the bow string of said bow, said archery bow support comprising:

a bow holder having a bow receptacle and a bow passage leading into said bow receptacle for retaining said bow in an upright position;

said bow receptacle being larger than the depth of said hand grip;

said bow holder passage being smaller than the depth of said hand grip, and said bow passage being larger than the width of said hand grip, so that said bow may be rotated to a side facing position for being received thru said bow passage and thereafter roatated to a forward facing position for retention within said bow receptacle; and a mount for mounting said bow support to an associated structure;

whereby said bow holder supports said archery bow in an upright position for easy accessibility.

6. The archery bow support of claim 5 including an extension arm carried by said mount extending generally horizontally away from said associated structure when said mount is attached to said associated structure.

7. The archery bow support of claim 6 including a vertical bow support leg depending from said extension arm opposite said mounting leg for supporting said bow in a generally vertical position.

8. The archery bow support of claim 7 including a second hook element integral with said vertical bow support leg, said second hook element disposed below said first hook element, said second hook element providing said bow holder with two points of contact with said archery bow restricting movement of said archery bow.

* * * * *